US006930259B1

(12) United States Patent
Jorgensen et al.

(10) Patent No.: US 6,930,259 B1
(45) Date of Patent: Aug. 16, 2005

(54) ENCODER

(75) Inventors: Martin Bondo Jorgensen, Smorum (DK); Soren Ravnkilde, Ballerup (DK)

(73) Assignee: Sonion A/S, Roskilde (DK)

( * ) Notice: Subject to any disclaimer, the term of this patent is extended or adjusted under 35 U.S.C. 154(b) by 0 days.

(21) Appl. No.: 10/018,065

(22) PCT Filed: May 31, 2000

(86) PCT No.: PCT/DK00/00298

§ 371 (c)(1),
(2), (4) Date: Jul. 18, 2002

(87) PCT Pub. No.: WO00/77806

PCT Pub. Date: Dec. 21, 2000

(30) Foreign Application Priority Data

Jun. 10, 1999 (DK) ..... 1999 00824

(51) Int. Cl.[7] ..... H01H 9/00
(52) U.S. Cl. ..... 200/4; 200/11 DA; 200/11 R
(58) Field of Search ..... 200/4, 11 R, 11 D, 200/11 DA, 11 G, 19.12, 19.18, 18

(56) References Cited

U.S. PATENT DOCUMENTS

| | | | | |
|---|---|---|---|---|
| 5,446,481 A | | 8/1995 | Gillick et al. | |
| 5,448,240 A | * | 9/1995 | Morito | 341/176 |
| 5,987,336 A | | 11/1999 | Sudo et al. | |
| 6,097,964 A | | 8/2000 | Nuovo et al. | |
| 6,211,474 B1 | | 4/2001 | Takahashi | |
| 6,218,635 B1 | | 4/2001 | Shigemoto et al. | |
| 6,333,473 B1 | | 12/2001 | Sawada et al. | |

FOREIGN PATENT DOCUMENTS

| | | | |
|---|---|---|---|
| EP | 0 531 829 A | | 3/1993 |
| EP | 0 874 382 A | | 10/1998 |
| EP | 0 901 262 A | | 3/1999 |
| EP | 1014410 A1 | | 6/2000 |
| GB | 2 260 598 A | | 4/1993 |
| GB | 2329070 A | | 3/1999 |
| GB | 2329083 A | | 3/1999 |
| GB | 2329094 A | | 3/1999 |
| JP | 10-312728 | * | 11/1998 |
| WO | WO 99/19861 | | 4/1999 |

* cited by examiner

*Primary Examiner*—K. Lee
(74) *Attorney, Agent, or Firm*—Harness, Dickey & Pierce, PLC

(57) ABSTRACT

The present invention relates to an electromechanical roller-key assembly of simple and robust construction. The assembly may be integrated in electronic equipment and generate digital control signals in response to an instantaneous change in angular position of a user-operated roller. The roller-key assembly according to the present invention is suitable for being manufactured with very small outer dimensions and with fewer and simpler mechanical parts compared to prior art roller-key assemblies, thereby making the roller-key assembly suitable for a simplified and automated factory assembly.

11 Claims, 5 Drawing Sheets

ENCODER

FIELD OF THE INVENTION

The present invention relates to encoder-switch assemblies such as electromechanical roller-key assemblies that comprise an encoder part and an actuator switch. The encoder part may operate according to magnetic, optical and/or electromechanical principles and may provide one or several electrical output signals indicating the instantaneous change of angular position of a rotating roller or tuning wheel of the encoder part of the encoder-switch assembly.

The encoder-switch assemblies according to the present invention are particularly well adapted for use in mobile phones or, generally, in any type of electronic equipment that will benefit from the very small outer dimensions and simple construction of the encoder-switch assemblies.

BACKGROUND OF THE INVENTION

Electromechanical roller-key assemblies may be used to generate digital control signals in response to a rotation of a roller or tuning knob and to generate an actuator switch signal in response to a depression. Such rollers are known from e.g. mobile phones. However, the mechanical constructions of these known devices have certain drawbacks due to a large number of miniature movable and stationary parts, often including a tiny detent spring element. This large number of separate parts requires a quite complex and labour intensive assembly procedure to assure that all parts are carefully aligned with respect to each other.

Accordingly, there is a need for an encoder-switch assembly of simplified construction with fewer parts compared to prior art assemblies so as to simplify the assembly procedure, reduce the assembly time and, consequently, lower the costs of integrating such encoder-switch assemblies in today's mobile phones and similar compact electronic equipment.

SUMMARY OF THE INVENTION

It is an object of the present invention to provide an electromechanical roller-key assembly of simple and robust construction. The assembly may be integrated in electronic equipment and generate digital control signals in response to the instantaneous change in angular position of a user-operated roller.

It is a further object of the present invention to provide an electromechanical roller-key assembly suitable for being manufactured with very small outer dimensions. Such miniaturisation is a key requirement for applications in e.g. hearing aids, compact mobile phones pagers, medical dispensing devices and similar handheld or body-worn devices, etc.

It is a further object of the present invention to provide an electromechanical roller-key assembly comprising fewer and simpler mechanical parts compared to prior art roller-key assemblies, thereby making the present electromechanical roller-key assembly suitable for a simplified and automated factory assembly.

In a first aspect, the present invention relates to an encoder-switch assembly comprising, a first member, said first member being supported by a frame and being rotatably mounted in relation to the frame, the frame having a first part and a second part, the first part being adapted to support the first member and being displaceable relative to the second part so as to render the first member displaceable in relation to the second part from an initial position to a displaced position, a coding member engaging the first member in a manner so as to rotate when the first member rotates, means for returning the first member from the displaced position to the initial position, means for detecting rotation of the coding member in relation to the frame, and switching means for indicating when the first member is in the displaced position, characterised in that the returning means is made from a plate-shaped resilient material and is constituted by the frame.

Accordingly, a roller-key assembly according to the present invention may be provided with a coding member operating by different sensing principles, such as electromechanical, optical, inductive, capacitive etc. principles.

The frame may be provided in a plate-shaped resilient material e.g. a metallic material of suitable thickness. The first part and the second part of the frame may be separated by one or more indentations to provide regions with higher resiliency compared to regions of the frame abutting the one or more indentations. By attaching the second part to a housing of an apparatus, the frame functions as a torsion bar element when a user depresses the first member in order to activate the switching means. Accordingly, the frame provides a built-in detent spring functionality.

The switching means may be adapted to indicate the displaced position of the first member by forming an electrical connection between a protrusion of the first part of the frame and an electrical conductor or pad positioned in a fixed manner relative to the second part of the frame and/or relative to the external housing or casing or frame. This has the advantage that it provides a much simpler actuator switch element compared to prior art membrane switches.

The coding member may be integrated with a substantially cylindrically shaped first member by forming a part of the coding member. Said part may be provided by arranging between 5 and 25 protrusions along a substantially axially oriented surface path on an end surface of the cylindrically shaped member.

A disc-shaped metal plate comprising between 5 and 25 hours of dimensions corresponding to th dimensions of the protrusions may be fitted onto the end surface of the first member so as to form a circular and plane encoding disc. The protrusions thus provide a number of non-conducting pads on the encoding disc while the metal areas constitute electrically conducting pads. In this configuration, the intermittently arranged conducting and non-conducting pads may be electrically interconnected by a circular area of the metal plate. The pads and the circular area may be contacted by scanning means comprising a first, a second and a third contact member. The circular area thus provides a conducting path without the intermittent pattern of conduction and non-conducting pads and may be used as an electrical contact path for the third contact member during rotation of the disk.

Each of the contact members may be electrically connected to a corresponding externally accessible pin or terminal. The pins associated with the first and second contact members may each be connected, through a predetermined pull-up resistor, to a voltage supply provided by an electronic apparatus into which the electromechanical encoder is to be integrated. The leg part or pin associated with the third contact member may be directly connected to a ground terminal in the apparatus so that by rotating the encoder disk short circuits and open circuits are intermittently generated between the first pin and the third pin and between the second pin and the third pin. Consequently, on each of the first and the second pin a pulse train is generated that comprises a number of pulses per revolution of the encoding disk proportional to the number of conducting pads arranged on the encoding disk.

The rotatably mounted cylindrically shaped first member may function as a user operated roller. The roller may comprise corrugated grooves disposed along a substantially axially oriented surface path on the end of the cylindrically shaped member opposite to the end that comprises the encoding disc. The grooves may be in contact with a spring member formed in the frame and provide a biasing force against the corrugated grooves, thereby providing a user op rating the roller with tactile feedback to assist the user in determining the angular rotation of the roller.

In a second aspect, th present invention relates to an encoder-switch assembly comprising, a frame, a first member supported by the frame and being rotatably and displaceably mounted in relation to the frame, wherein the first member is rotatable in relation to the frame in a first plane, and wherein the first member is displaceable in relation to the frame between an initial position and a displaced position, a resilient element for returning the first member from the displaced position to the initial position, switching means for indicating when the first member is in the displaced position, a coding member engaging the first member in a manner so as to rotate when the first member rotates, the coding member being fixedly connected to the frame, and the first member being rotatably mounted in relation to the coding member, means for transferring a rotation of the first member to the coding member, and means for detecting rotation of the coding member in relation to the frame.

The transferring means may comprise a substantially rigid shaft, a first end of said substantially rigid shaft being connected to the first member in a manner so that the shaft is rotatable in relation the first member in a plane not being parallel to the first plane, a second and of said substantially rigid shaft being connected to the coding member in a manner so that the shaft is rotatable in relation the first member in a plan not being parallel to the first plane.

Part of the shaft at thirst end may have a predetermined geometrical shape. The first member may have a corresponding inverse geometrical shape being adapted to receive and engage part of the shaft in a manner so that a rotation of the first member is transferred from the first member to the shaft, when the first member is rotated in the first plane.

The dimensions of the corresponding inverse geometrical shape of the first member may be larger than the corresponding outer dimensions of the predetermined geometrical shape of the shaft.

BRIEF DESCRIPTION OF THE DRAWINGS

In the following, preferred embodiments of electromechanical roller-key assemblies according to the present invention are described with reference to the accompanying drawings, wherein.

DETAILED DESCRIPTION OF PREFERRED EMBODIMENTS

Figure 1:
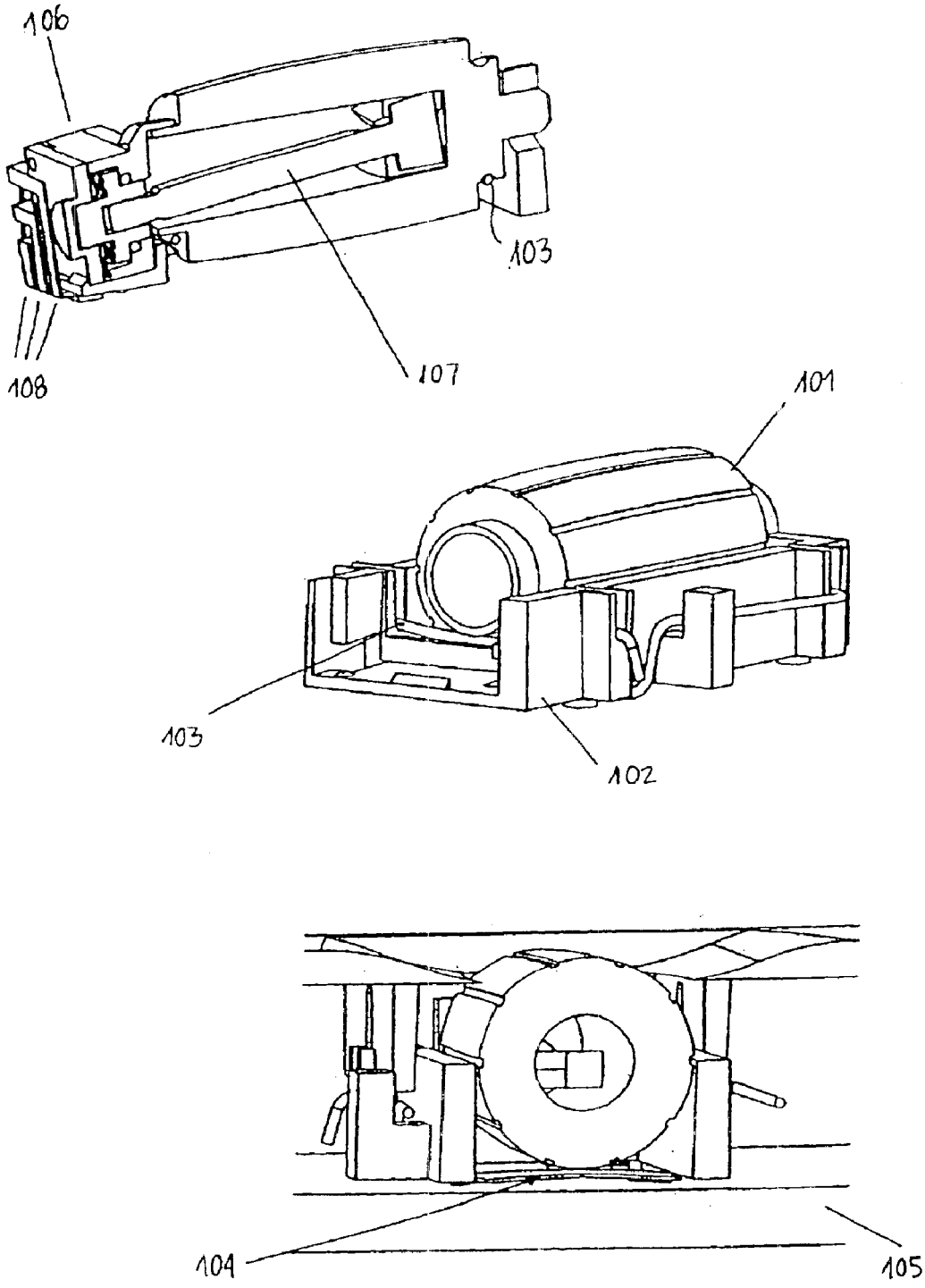
FIG. 1 shows a cross-sectional view and two perspective views of a first embodiment of an electromechanical roller-key assembly according to the present invention.

FIG. 1 shows various views of an electromechanical roller-key assembly according to a first preferred embodiment of the invention. A plastic moulded cylindrical roller 101 is rotatably mounted in a supporting frame 102. A detent spring 103 is also mounted on the frame and further attached to or abutting the roller in a manner that allows the roller to return to a rest position after it has been vertically depressed in order to activate a membrane switch 104 which may be positioned be low the roller on e.g. a printed circuit board (PCB) 105. The rotation of the roller is transferred to a coding member 201 (FIG. 2) housed in an encoding module 106 by means of a shaft 107 that provides a relatively rigid connection between the roller and the coding member.

Figure 2:
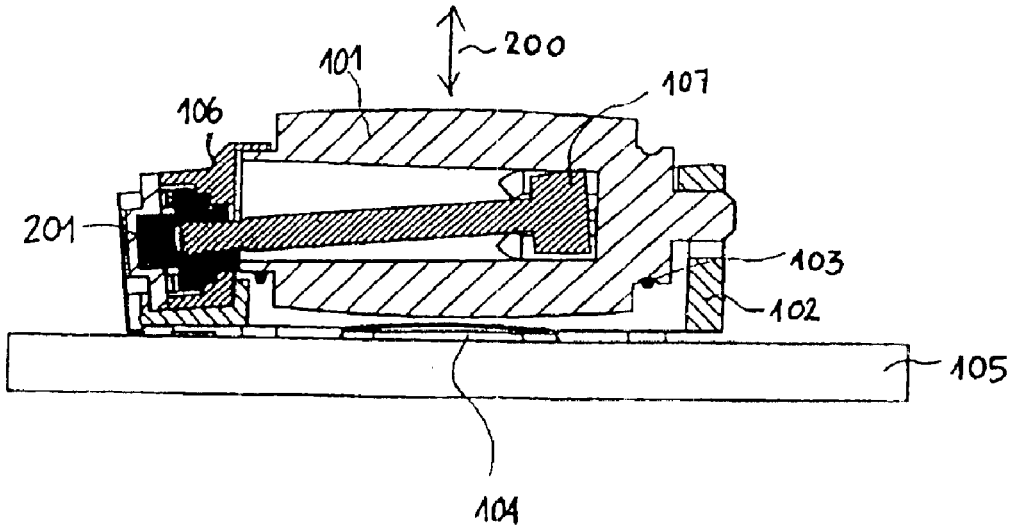
FIG. 2 is a cross-sectional view of the assembled electromechanical roller-key assembly illustrated in FIG. 1.

FIG. 2 illustrates that predetermined clearance is provided at both ends of the shaft 107, this clearance provides a mechanism that allows the roller 101 to move vertically (in the direction illustrated by arrow 200) without transferring such vertical movement to the encoding module 106. The encoding module 106 and the frame 102 may accordingly be fixed to the same PCB 105 as the membrane switch 104 by directly soldering the three leg parts of contact members 108 (FIG. 1) to corresponding solder pads located on the PCB 105. Consequently, the present embodiment of the invention does not require flexible connection wires or equivalent flexible connecting means in order to transfer electrical signals from the encoding module 106 to detecting circuitry arranged on the PCB 105. Preferably, the electromechanical roller-key assembly also comprised an O-ring 109 (FIG. 1) positioned between the frame 102 and the coding member 201 to seal the encoding module 106 and the coding member 201 from moist and other external contamination.

Figure 3:
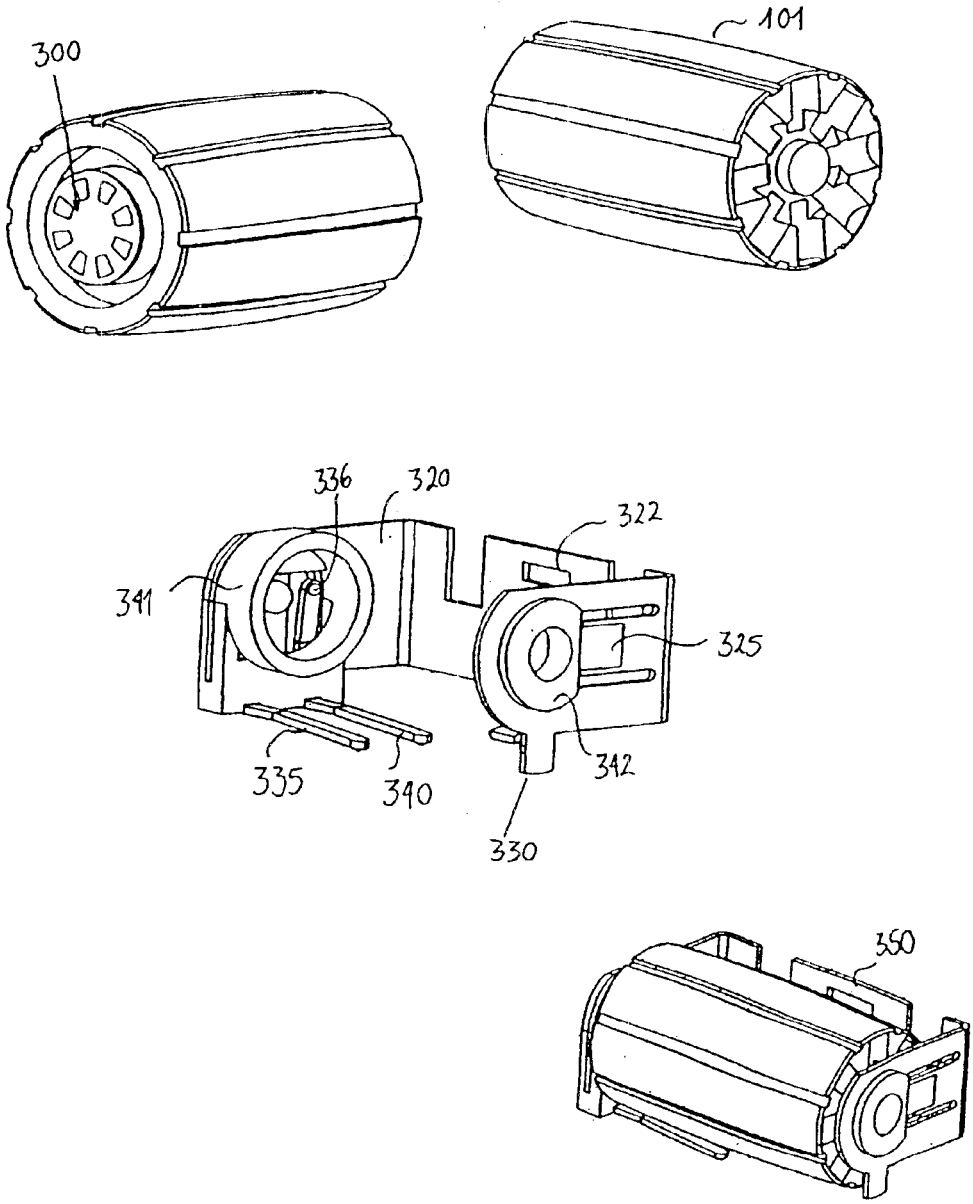
FIG. 3 shows four different perspective views of various elements of a third embodiment of an electromechanical roller-key assembly according to the present invention.

FIG. 3 shows various elements of an electromechanical roller-key assembly according to another preferred embodiment of the invention. An assembled roller key assembly 350 is also illustrated in a perspective view. A plastic moulded cylindrical roller 101 is rotatably mounted in a metal frame 320. A first end surface of the roller 101 contains a corrugated groove adapted to contact a detention spring protrusion 325 formed in the metal frame 320 when the roller 101 is mounted in the frame 320. A disc-shaped coding member is formed in a second end of th roller 101 by pressing and aligning a number of holes in a metal disc 300 onto a number of corresponding protrusions, which are moulded in the second end of the roller. The holes and protrusions may be arranged along a substantially axially oriented surface path relative to an axis of rotation of the coding member. Accordingly, the second end of the member may constitute an encoding disk comprising a number of intermittently arranged conducting and non-conducting pads. By providing the protrusions on the roller 101 with substantially the same height as the thickness of the metal disc 300 a plane surface of the coding member may be provided and contacted by scanning means comprising a first, a second and a third contact member, 335, 336, and 340, respectively. The third contact member 336 is formed in the metal frame 320 and thereby electrically connected to it. Thereby, during rotation of the coding member, electrical contact is intermittently established from the first and the second contact member, 335 and 340, respectively, to the at least one third contact member and two pulse trains of differing phase with respect to each other may be provided at the leg parts of the first and second contact members by connecting each of the leg parts of the first and second contact member to an appropriate supply voltage through pull-up resistors.

Figure 4:
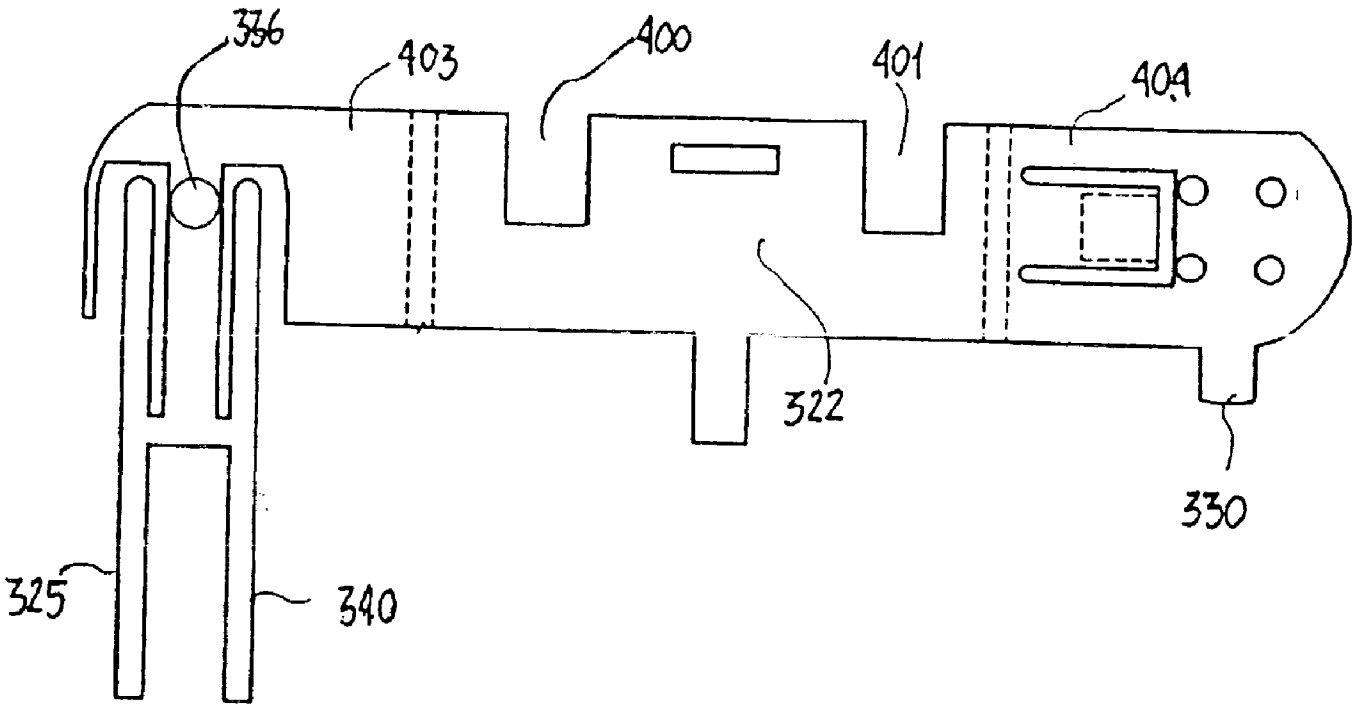
FIG. 4 illustrates a metal frame which forms part of the electromechanical roller-key assembly shown in FIG. 3.

The metal frame 320 is preferably manufactured in a single piece of plate-shaped material as illustrated in FIG. 4. The metal frame 320 is divided into a first part (403 and 404) which is adapted to support the roller at its end surfaces, and a second part 322 which can be rigidly mounted in a casing or housing of an apparatus (not shown) in which the roller key assembly is to be integrated.

By providing two indentations, 400 and 401 in FIG. 4, in the metal frame 320 the first part (403 and 404) is made displaceable in relation to the second part 322. Accordingly, when the second part 322 is rigidly mounted in an apparatus housing and a force is applied to the roller, the first part (and the roller holding the coding member) is displaced from a rest or initial position to an activated position and a torsion spring force is created in the first part so as to return the roller to its rest position when the applied force is removed. Accordingly, the frame itself functions as a detent spring so that there is no need for a separate spring element. Another advantage of the metal frame is it may further act as a de-coupling element of electrostatic charge that may build up on the roller.

The displacement of the first part may bring an actuator contact 330 which is integrated with the first part of the metal frame 320 in electrical contact with a electrically conducting pad arranged on e.g. a printed circuit board and positioned below the actuator contact 330. Thereby an actuator switch element is integrated together with the electromechanical roller-key assembly 350 and this switch element may provide two level switching signals to a detection circuit in response to a user depressing and releasing the roller.

The first and second contact members 335 and 340 are preferably provided as an integrated part of the metal frame 320. By utilising an insert moulding process, two plastic bearing elements 341 and 342 are attached to the first part of the metal frame. The first and second contact members 335 and 340 must be mechanically and electrically separated from each other and from the metal frame 320 before or after the insert moulding process so as to provide 3 electrically separate contact members. The plastic bearing elements are utilised to mount the roller in a precise predetermined and rotatable manner relative to the metal frame 320 and to the first, second and third contact members.

A mechanical connection in the form of a cross-bar or shaft may be added between elements 403, 404 (FIG. 4) of the metal frame after it has been bend into a U-shape at the marked regions, as illustrated in FIG. 3, thereby providing a frame of improved mechanical stability.

Figure 5:
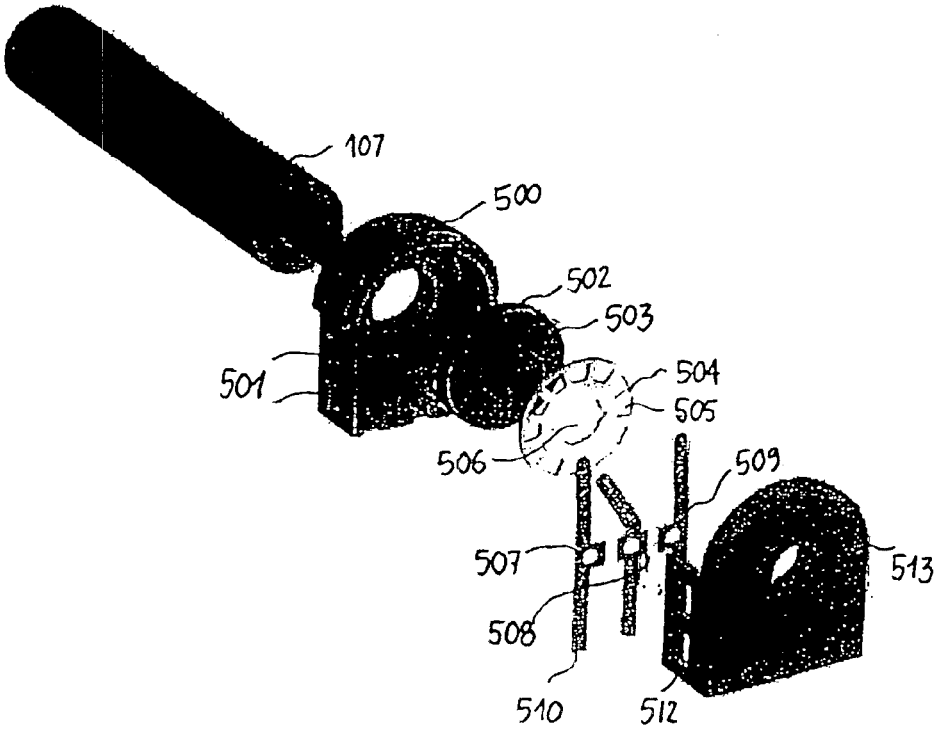
FIG. 5 illustrates an exemplary electromechanical encoder having a suitable disc-shaped coding member for us in the electromechanical roller-key assembly shown in FIG. 3.

FIG. 5 is a perspective view of a number of separate elements comprised in an exemplary electromechanical encoder unit. A member 502, constituting a first part of the encoder unit, is provided as a single part moulded in a thermoplastic material with or without reinforcement. The member 502 also defines the positions of the non-conducting pads (protrusions) 503 of the encoder unit by means of twelve wedge-shaped protrusions arranged along a substantially axially oriented path relative to an axis of rotation of the disk. A conducting member 504 which is provided as a circular disk with a centrally located circular aperture 506 constitutes a second part of the encoder unit. This member 504 comprises a number of wedge-shaped apertures 505 adapted to fit into the corresponding protrusions 503 provided in the member 502. The member 504 may be provided by different manufacturing methods such as through insert moulding or through depositing a layer of conductive material in the preferred pattern on the thermoplastic member 502. The pads are thus arranged as a circular measuring scale between two radial boundaries positioned relatively near to the circumference of the encoding disk, and the circular area may be positioned inside or outside of the circular measuring scale. Thereby, a circular area or path is left without the intermittent pattern of pads so that this path may be used as a contact path for the third contact member during rotation of the disk. The circular aperture 506 is adapted to receive the end part of a shaft 107 that may be operated by a user. Front and rear housing parts 500 and 513, respectively are provided with contact means 512 which provides snap-fit assembly of the housing parts. Furthermore, an inner surface in the rear part 513 is provided with a projection abutting against each of the at least three contact members to provide a contact or bias force between the contact members and the encoding disk.

A first electrical conductive terminal or leg part 507 comprises the second contact member (not shown) and a corresponding externally accessible pin 510. Terminal 507, 508 and 509 are, preferably, provided in a solderable material and/or corrosion-resistant material such as copper, silver, gold-coated steel, palladium-nickel, gold-platinum, gold-nickel alloys, etc. Each of the terminals 508 and 509 are also provided with contact members (not shown) and an externally accessible terminal.

What is claimed is:

1. An encoder-switch assembly comprising, a first member, said first member being supported by a frame and being rotatably mounted in relation to the frame, the frame having a first part and a second part, the first part being adapted to support the first member and being displaceable relative to the second part so as to render the first member displaceable in relation to the second part from an initial position to a displaced position, a coding member engaging the first member in a manner so as to rotate when the first member rotates, means for returning the first member from the displaced position to the initial position, said returning means being made from a plate-shaped resilient material and being constituted by at least part of the frame, means for detecting rotation of the coding member in relation to the frame, and switching means for indicating when the first member is in the displaced position.

2. An encoder-switch assembly according to claim 1, wherein the frame is made from a plate-shaped resilient material.

3. An encoder-switch assembly according to claim 1, wherein the first part and the second part of the frame are separated by one or more indentations.

4. An encoder-switch assembly according to claim 1, wherein the second part of the frame further comprises engaging means, said engaging means being substantially rigidly attached to corresponding engaging means of an external housing or casing or frame.

5. An encoder-switch assembly according to claim 1, wherein the switching means is adapted to indicate an electrical connection between a protrusion of the first part of the frame and an electrical conductor or pad positioned in a fixed manner relative to the second part of the frame.

6. An encoder-switch assembly according to claim 1, wherein part of the coding member is integrated with the first member.

7. An encoder-switch assembly according to claim 1, wherein the first member comprises a substantially cylindrically shaped member having part of the coding member formed on an end surface part.

8. An encoder-switch assembly according to claim 7, wherein part of the coding member is provided by arranging between 5 and 25 protrusions along a substantially axially oriented surface path on the end surface part of the substantially cylindrically shaped member.

9. An encoder-switch assembly according to claim 8, wherein the coding member is formed by mounting a metal disc on the end surface part of the substantially cylindrically shaped member, the metal disc comprising between 5 and 25 holes of dimensions essentially equal to the dimensions of the protrusions of the coding member.

10. An encoder-switch assembly according to claim 9, further comprising at least three contact members being adapted to scan the end surface part of the substantially cylindrically shaped member, each contact member having a corresponding leg part.

11. An encoder-switch assembly according to claim 1, wherein the coding member comprises a disc-shaped member comprising a number of intermittently positioned holes along an axially oriented path of the disc-shaped member, and wherein the detecting means comprises a light emitter positioned in a manner so as to transmit light through the holes of the disc-shaped member to a detector positioned in a manner so as to receive light pulses when the disc-shaped member is rotated.

* * * * *